US007614764B2

(12) United States Patent
Williams et al.

(10) Patent No.: US 7,614,764 B2
(45) Date of Patent: Nov. 10, 2009

(54) METHOD AND APPARATUS FOR JOINING LINEAR LIGHT FIXTURES USING RADIALLY ORIENTED KEYHOLES

(75) Inventors: Rodney Williams, Auburn, IN (US); Geza T. Lanczy, Auburn, IN (US)

(73) Assignee: Group Dekko, Inc., Kendallville, IN (US)

( * ) Notice: Subject to any disclaimer, the term of this patent is extended or adjusted under 35 U.S.C. 154(b) by 77 days.

(21) Appl. No.: 11/608,461

(22) Filed: Dec. 8, 2006

(65) Prior Publication Data

US 2007/0211478 A1 Sep. 13, 2007

Related U.S. Application Data

(60) Provisional application No. 60/748,876, filed on Dec. 8, 2005.

(51) Int. Cl.
*F21V 7/20* (2006.01)

(52) U.S. Cl. ..... 362/249; 362/217; 362/219; 362/365; 362/225

(58) Field of Classification Search ..... 362/153, 362/217, 225, 219, 365
See application file for complete search history.

(56) References Cited

U.S. PATENT DOCUMENTS

| | | | | |
|---|---|---|---|---|
| 6,536,924 | B2 * | 3/2003 | Segretto | 362/345 |
| 2007/0008717 | A1 * | 1/2007 | Flaherty | 362/153 |
| 2007/0211478 | A1 * | 9/2007 | Williams et al. | 362/382 |

* cited by examiner

*Primary Examiner*—Anabel M Ton
(74) *Attorney, Agent, or Firm*—Taylor & Aust, P.C.

(57) ABSTRACT

A linear light fixture includes a housing having a back and a pair of end plates. At least one end plate has a pair of mounting features. At least one of the mounting features is an elongate mounting feature with a longitudinal axis oriented generally tangent to a radius arc originating from a point which is offset from the back.

13 Claims, 4 Drawing Sheets

METHOD AND APPARATUS FOR JOINING LINEAR LIGHT FIXTURES USING RADIALLY ORIENTED KEYHOLES

CROSS REFERENCE TO RELATED APPLICATIONS

This is a non-provisional application based upon U.S. provisional patent application Ser. No. 60/748,876, entitled "METHOD AND APPARATUS FOR JOINING LINEAR LIGHT FIXTURES USING RADIALLY ORIENTED KEYHOLES", filed Dec. 8, 2005.

BACKGROUND OF THE INVENTION

1. Field of the Invention

The present invention relates to linear light fixtures such as fluorescent light fixtures, and, more particularly, to methods of joining adjacent linear light fixtures together.

2. Description of the Related Art

Linear light fixtures are commonly used in commercial and industrial environments, and also less commonly in home environments. An example of a linear light fixture is a fluorescent light fixture having one or more pairs of elongate fluorescent light bulbs positioned parallel to each other. A pair of dual lamp holders are positioned in line with each other, and each fluorescent light bulb is installed into the lamp holder and rotated approximately 90 degrees for mechanical and electrical connection.

The housing for a typical fluorescent light fixture includes a lens, a pair of end plates and a pair of side walls. The back of the fixture is mounted against the bottom of a horizontal surface such as a ceiling, or the underside of a storage cabinet over a work surface in a work area. It may be desirable, depending upon the particular application, to mount the light fixtures in an end-to-end manner. The light fixtures can simply be aligned end to end, and the housings fastened to the horizontal mounting surface using fasteners such as screws, etc. Alternatively, it is possible to provide a light fixture with a long housing having multiple lamp holders arranged alonged the length thereof. However, the use of a long housing may pose handling problems during shipping and installation. Further, it may also be desirable to suspend linear light fixtures from the horizontal mounting surface, in which event it is difficult to position the light fixtures so that they have the appearance of a continuous elongate light fixture without actually being connected together.

What is needed in the art is a linear light fixture and joining method which allows quick and easy connection of light fixtures in an end-to-end manner.

SUMMARY OF THE INVENTION

The present invention provides a linear light fixture having end plates provided with a twist and lock feature such that adjacent light fixtures can be coupled in an end-to-end manner quickly and easily.

The invention in one form is directed to a linear light fixture, including a housing having a back and a pair of end plates. At least one end plate has a pair of mounting features. At least one of the mounting features is an elongate mounting feature with a longitudinal axis oriented generally tangent to a radius arc originating from a point which is offset from the back.

The invention in another form is directed to a method of joining a first linear light fixture and a second linear light fixture together in an end-to-end manner, including the steps of:

providing a first linear light fixture having a first housing with a back and a pair of end plates, at least one end plate having a pair of first mounting features, at least one first mounting feature being an elongate mounting feature with a longitudinal axis oriented generally tangent to a radius arc originating from a point which is offset from the back;

providing a second linear light fixture having a second housing including a back and a pair of end plates, at least one end plate having a pair of second mounting features, at least one second mounting feature being an elongate mounting feature with a longitudinal axis oriented generally tangent to a radius arc originating from a point which is offset from the back;

coupling the first mounting features with the second mounting features; and rotating the first housing and/or the second housing to lock the first mounting features together with the second mounting features.

An advantage of the present invention is that it provides a secure way of connecting the fixtures that is easy for the installer to do.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention, and such exemplifications are not to be construed as limiting the scope of the invention in any manner.

DETAILED DESCRIPTION OF THE INVENTION

Figure 1:
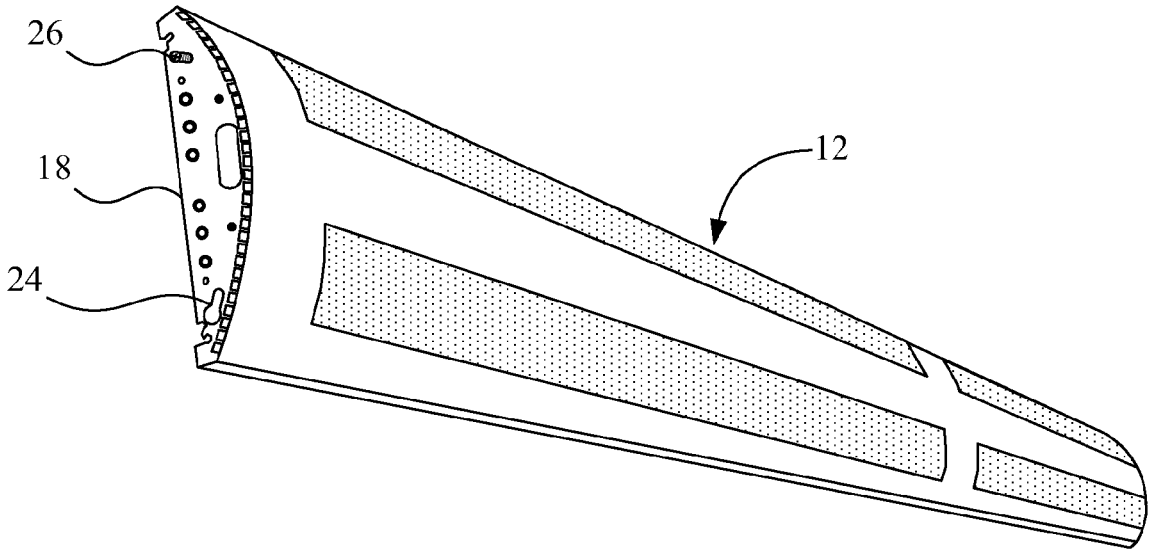
FIG. 1 is a perspective view of a linear light fixture of the present invention.
Figure 2:
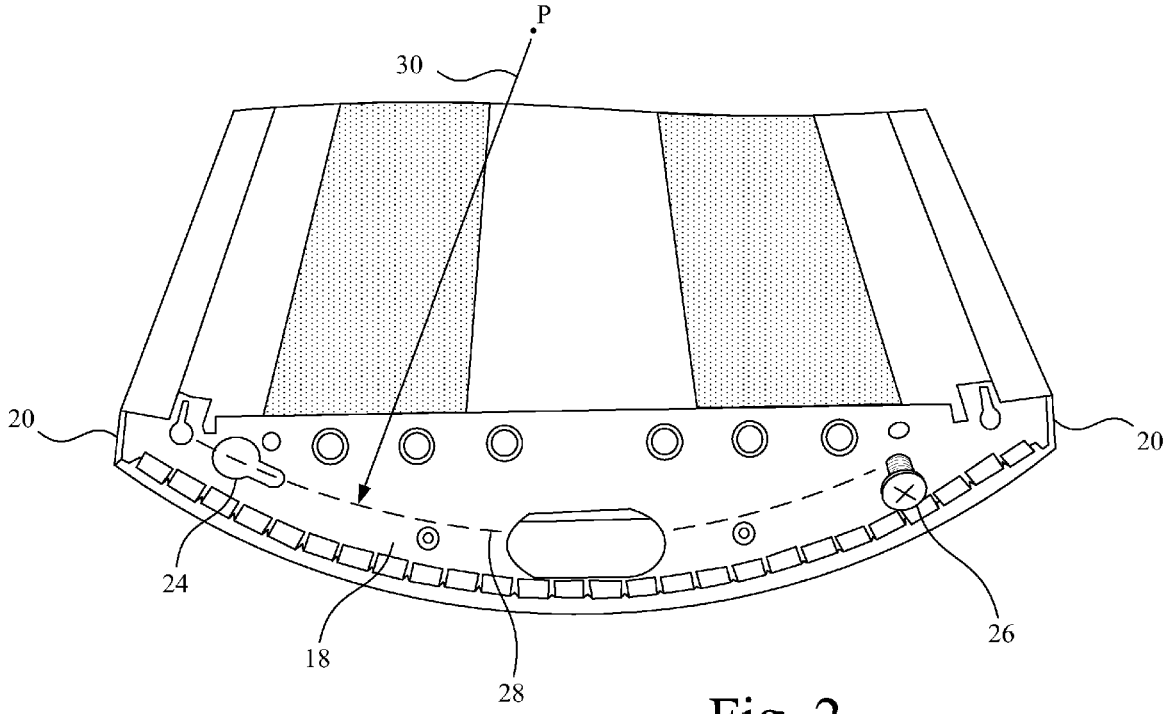
FIG. 2 is another perspective, fragmentary view of the linear light fixture shown in FIG. 1.
Figure 3:
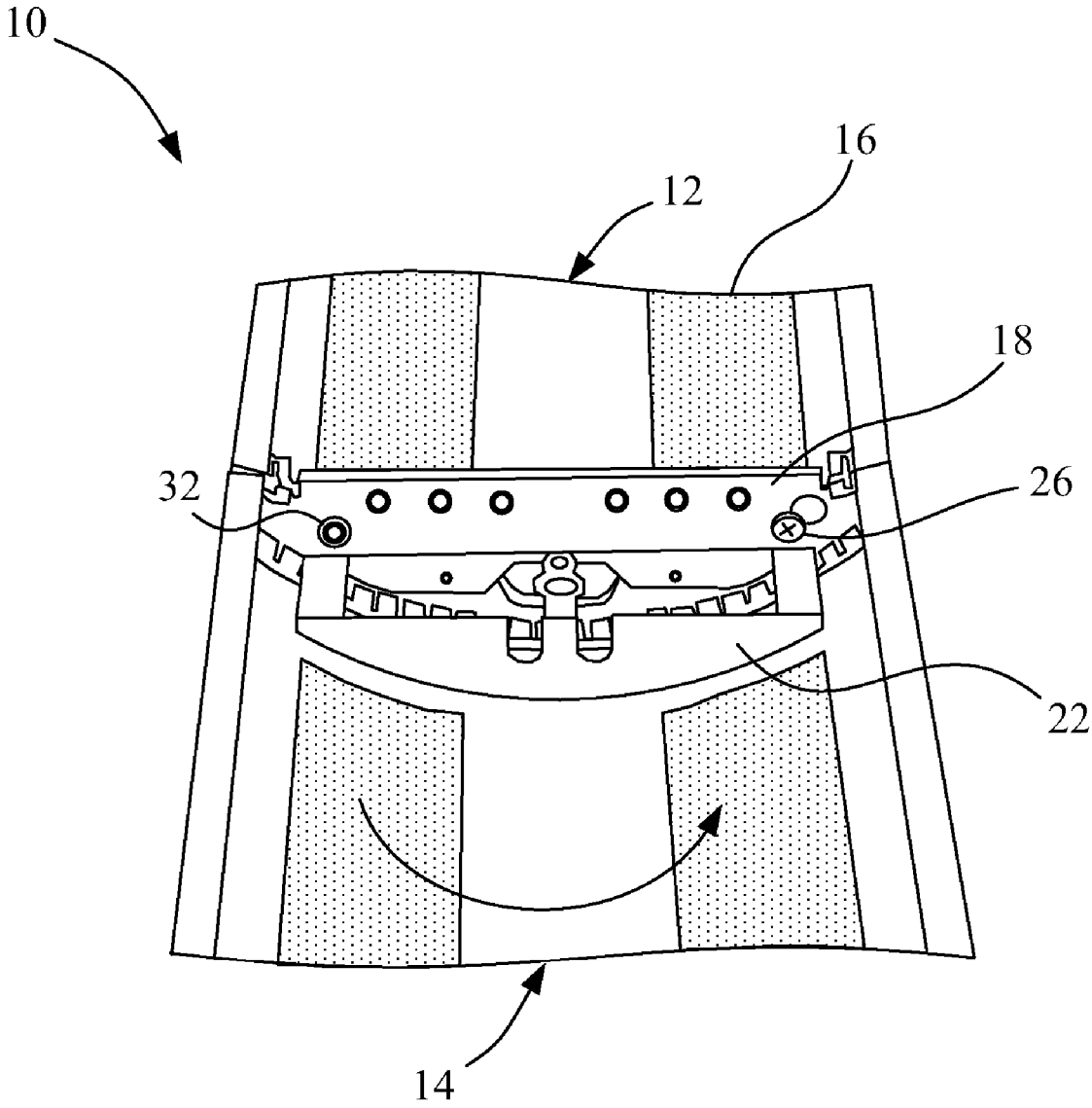
FIG. 3 is a perspective, fragmentary view of a linear light fixture assembly of the present invention, including two linear light fixtures connected in an end-to-end manner.

Referring now to the drawings, and more particularly to FIGS. 1-3, there is shown an embodiment of a linear light fixture assembly 10 of the present invention which generally includes a first linear light fixture 12 and a second linear light fixture 14. It is assumed that first linear light fixture 12 and second linear light fixture 14 are configured substantially identical in the illustrated embodiment, and therefore only first linear light fixture 12 will be described in greater detail hereinafter.

First linear light fixture 12 is configured as a fluorescent light fixture, but may be a different type of linear light fixture depending upon the application. For example, first linear light fixture 12 could also be configured as a linear LED light fixture having a linear array of LED's mounted on a circuit board. First linear light fixture 12 includes a housing 16 with a pair of end plates 18 (only one of which is shown). Each end plate 18 is positioned at a longitudinal end of housing 16, and is configured substantially identically, as will be described in more detail hereinafter. Alternatively, it is possible to form housing 16 with one end plate 18 configured as shown in the drawings, and an opposite end plate configured as a solid blank when exposed at the end of first linear light fixture 12.

Housing 16 also includes a pair of side walls 20 extending between end plates 18, and optionally a back plate (not shown) which extends between end plates 18 and side walls 20.

A pair of lamp brackets 22 are also mounted to housing 16. Each lamp bracket 22 is positioned adjacent a respective end plate 18, and carries a dual lamp holder (not shown) for mechanically and electrically interconnecting with a pair of fluorescent lamps (not shown).

First linear light fixture 12 and second linear light fixture 14 are placed in an end to end manner relative to each other and coupled together, as shown in FIG. 3. More particularly, adjacent end plates 18 of first linear light fixture 12 and second linear light fixture 14 each include a pair of mounting features 24 and 26 allowing quick, easy and simple interconnection between first linear light fixture 12 and second linear light fixture 14. In the embodiment shown in FIGS. 1-3, mounting feature 24 is in the form of an elongate mounting feature, more particularly a keyhole slot, and mounting feature 26 is in the form of a screw. Keyhole slot 24 and screw 26 are positioned along a common radius arc 28 which is defined by a radius 30 originating from a common point P which is offset from a back of first linear light fixture 12. Depending upon the particular shape of housing 16, radius 30 could originate from a common point P which is offset from the front side of housing 16 (such as when housing 16 has a generally rectangular cross-sectional shape). Configured as such, radius 30 still originates from a common point P which is offset from the back of housing 16, but towards the front rather than the rear of housing 16.

Keyhole slot 24 has a longitudinal axis 32 which is oriented generally tangent to radius arc 28 defined by radius 30. Orienting keyhole slot 24 in this manner along radius arc 28 allows a "twist and lock" coupling between longitudinally adjacent linear light fixtures 12 and 14.

During installation, adjacent end plates 18 of linear light fixtures 12 and 14 are aligned such that a screw 26 of one end plate aligns with a keyhole slot 24 of the adjacent end plate 18. End plates 18 are moved toward each other until each screw 26 is received within a corresponding keyhole slot 24. First linear light fixture 12 and/or second linear light fixture 14 are then rotated slightly until each screw 26 passes into the narrower slot portion of a respective keyhole slot 24. Screws 26 may then be tightened in a corresponding female threaded stud 32 which is welded to the back side of a corresponding end plate 18. First linear light fixture 12 and second linear light fixture 14 are then substantially rigidly coupled in an end-to-end manner relative to each other, and may be installed as a unit in a directly mounted or suspended manner from a desired surface. Typically the linear light fixture assembly 10 is mounted to or suspended from the underside of a horizontal surface, but may likewise be mounted vertically or at any other desired orientation, depending upon the application.

Figure 4:
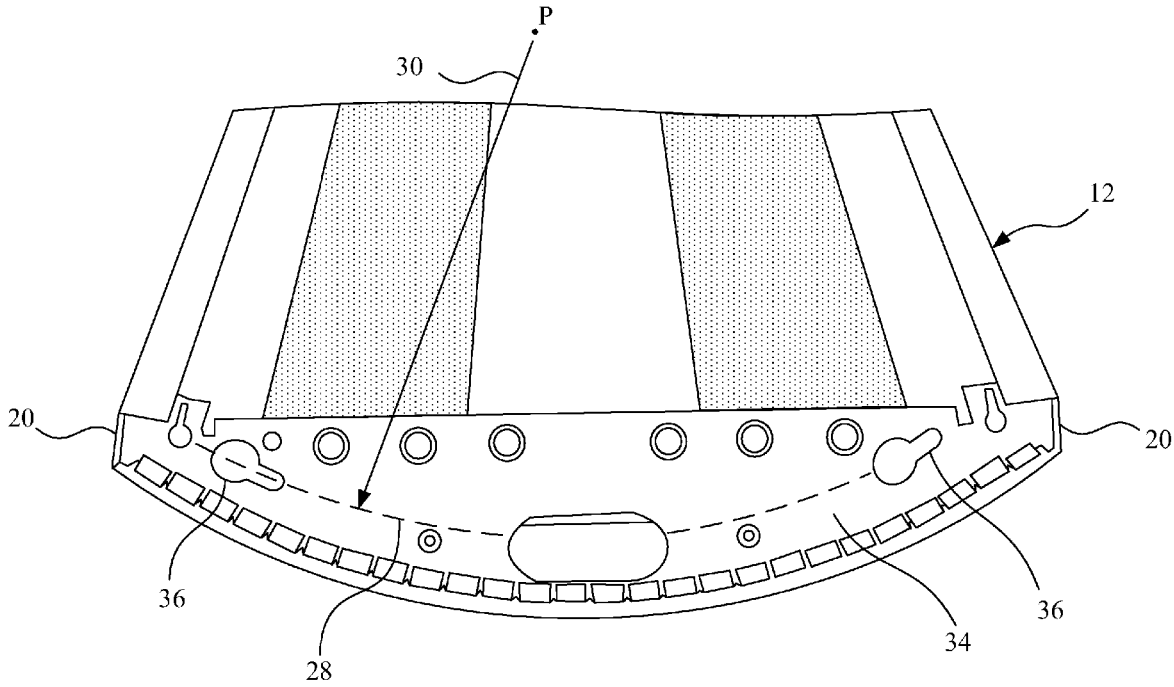
FIG. 4 is a perspective, fragmentary view of another embodiment of the linear light fixture of the present invention.

FIG. 4 shows another embodiment of the present invention in which one end plate 34 includes a pair of mounting features in the form of keyhole slots 36, and an end plate of an adjacent linear light fixture (not shown) includes mounting features in the form of screws which are positioned and sized to be received within keyhole slots 36. Each keyhole slot 36 is oriented generally tangent to radius arc 28 as described above with reference to the embodiment shown in FIGS. 1-3. Thus, the interconnection technique for mounting such linear light fixtures in an end-to-end manner is substantially the same.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A linear light fixture assembly, comprising:

a first linear light fixture having a first housing with a back and a pair of end plates, at least one said end plate having a pair of first mounting features, at least one said first mounting feature being an elongate mounting feature with a longitudinal axis oriented generally tangent to a radius arc originating from a point which is offset from said back; and a second linear light fixture having a second housing including a back and a pair of end plates, at least one said end plate having a pair of second mounting features, at least one said second mounting feature being an elongate mounting feature with a longitudinal axis oriented generally tangent to a radius arc originating from a point which is offset from said back, wherein said second mounting features are coupled with said first mounting features, said first and second linear light fixtures being locked together using each of said first and second mounting features.

2. The linear light fixture of claim 1, wherein each said elongate mounting feature is a keyhole shaped slot in said end plate, the other one of said first mounting features being a screw, the other one of said second mounting features being a screw.

3. The linear light fixture of claim 1, wherein said radius arc associated with said first housing and said radius arc associated with said second housing each have a common length.

4. The linear light fixture of claim 1, wherein said linear light fixture comprises a fluorescent light fixture.

5. A method of joining a first linear light fixture and a second linear light fixture together in an end-to-end manner, comprising the steps of:

providing a first linear light fixture having a first housing with a back and a pair of end plates, at least one said end plate having a pair of first mounting features, at least one said first mounting feature being an elongate mounting feature with a longitudinal axis oriented generally tangent to a radius arc originating from a point which is offset from said back;

providing a second linear light fixture having a second housing with a back and a pair of end plates, at least one said end plate having a pair of second mounting features, at least one said second mounting feature being an elongate mounting feature with a longitudinal axis oriented generally tangent to a radius arc originating from a point which is offset from said back;

coupling said first mounting features with said second mounting features; and rotating at least one of said first housing and said second housing to lock said first mounting features together with said second mounting features, said first and second linear light fixtures being locked together using each of said first and second mounting features.

6. The method of joining of claim 5, wherein each said elongate mounting feature is a keyhole shaped slot in said end plate.

7. The method of joining of claim 5, wherein said radius arc associated with said first housing and said radius arc associated with said second housing each have a common length and origin relative to a respective said back.

8. A linear light fixture, comprising:

a housing including a back and a pair of end plates, at least one said end plate having a pair of mounting features, at least one said mounting feature being an elongate mounting feature with a longitudinal axis oriented generally tangent to a radius arc originating from a point which is offset from said back, each of said mounting features being configured for being used to lock the linear light fixture with another linear light fixture in an end-to-end relationship.

9. The linear light fixture of claim 8, wherein said at least one elongate mounting feature is a keyhole shaped slot in said end plate.

10. The linear light fixture of claim 9, wherein said pair of mounting features includes one said keyhole shaped slot and one mounting screw.

11. The linear light fixture of claim 9, wherein said pair of mounting features includes two said keyhole shaped slots.

12. The linear light fixture of claim 8, wherein said radius arc originates from a point which is offset from a rear of said back.

13. The linear light fixture of claim 8, wherein each of said linear light fixtures comprises respectively a fluorescent light fixture.

* * * * *